US006968724B2

(12) United States Patent
Hubball

(10) Patent No.: US 6,968,724 B2
(45) Date of Patent: Nov. 29, 2005

(54) METHOD AND APPARATUS FOR MAKING A CAN LID SHELL

(75) Inventor: Martin M. Hubball, Arlington Heights, IL (US)

(73) Assignee: Metal Container Corporation, St. Louis, MO (US)

( * ) Notice: Subject to any disclaimer, the term of this patent is extended or adjusted under 35 U.S.C. 154(b) by 132 days.

(21) Appl. No.: 10/107,941

(22) Filed: Mar. 27, 2002

(65) Prior Publication Data

US 2003/0182983 A1 Oct. 2, 2003

(51) Int. Cl.[7] ..... B21D 51/44
(52) U.S. Cl. ..... 72/348; 72/379.4
(58) Field of Search ..... 72/348, 349, 350, 72/351, 379.4

(56) References Cited

U.S. PATENT DOCUMENTS

| | | | | |
|---|---|---|---|---|
| 3,302,441 A | | 2/1967 | Bozek | |
| 3,564,895 A | * | 2/1971 | Pfanner et al. | 72/351 |
| 4,365,499 A | * | 12/1982 | Hirota et al. | 72/351 |
| 4,713,958 A | | 12/1987 | Bulso, Jr. et al. | |
| 4,955,223 A | | 9/1990 | Stodd | |
| 5,309,749 A | | 5/1994 | Stodd | |
| 6,505,492 B2 | * | 1/2003 | Jroski | 72/348 |
| 6,526,799 B2 | * | 3/2003 | Ferraro et al. | 72/349 |
| 6,658,911 B2 | * | 12/2003 | McClung | 72/336 |

FOREIGN PATENT DOCUMENTS

| | | |
|---|---|---|
| EP | 0 340 955 A1 | 11/1989 |
| EP | 1 105 232 A0 | 3/2000 |
| FR | 2713137 | 6/1995 |
| WO | WO 01/60546 A1 | 8/2001 |

OTHER PUBLICATIONS

Avallone et al., Marks' Standard Handbook for Mechanical Engineers, (10th ed. 1996).*

* cited by examiner

*Primary Examiner*—Lowell A. Larson
(74) *Attorney, Agent, or Firm*—Dawn C. Wolff; Storm LLP

(57) ABSTRACT

A method and apparatus for making can lid shells in die presses, with the addition of a forming ring within the die set. The forming ring is placed between the draw pad and die center, and is used to apply a force on the material during the shell lid forming process. Use of this apparatus reduces the amount of force that must be applied on the draw pad to hold the material between the die core ring and the draw pad during the forming process. By lessening the force needed to hold the material during the forming process, the probability of wrinkling or cracking of the material during the forming process is greatly reduced.

16 Claims, 6 Drawing Sheets

METHOD AND APPARATUS FOR MAKING A CAN LID SHELL

TECHNICAL FIELD

The present invention relates generally to the manufacture of can lids for use on metal beverage containers. More particularly, the invention relates to a novel method and apparatus for making a shell for a can lid requiring significantly less force during the forming process than current manufacturing methods.

BACKGROUND OF THE INVENTION

Aluminum cans are widely used as containers for retail sale of beverages in individual portions. Annual sales of such cans are in the billions and consequently, over the years, their design has been refined to reduce cost and improve performance. Additional refinements have been made in the production process and equipment used for manufacturing such containers to further reduce costs and eliminate scrap and waste.

The method and apparatus of the present invention are particularly adapted for making a shell for a can lid using current single-action or double-action mechanical presses, with redesigned tooling. Presently, a shell for a beverage can lid has a center panel, a countersink, and a seaming panel, which consists of an outer seaming portion and a connecting portion, although many variations of the basic can lid can be found in use. In some arrangement of can lids, the connecting portion is almost vertical. In more recent designs of can lids, the connecting portion has been formed at more of an angle from vertical. Beverage can lids are usually formed from relatively thin sheet metal materials. The formation of a can lid shell is a metal drawing operation. If the shell is made from round blanks of sheet metal, a single-action press is used to form and shape the lid. If the lid is made from a preformed cup, a double-action press is used for completion of forming and shaping the lid.

In the effort to reduce costs and improve performance, the sheet material used to manufacture cans and lids has become progressively thinner, and the alloys used stronger. Currently, the materials have an initial thickness of 0.0088 inches or less, this thickness being projected to continue to decrease with technological developments. As the sheet material used to form lids has become thinner, the forming of can lids has become more difficult, because the thinner materials are more prone to wrinkling and cracking of the sheet material during forming. This is especially true in can lids in which the connecting portion is at a greater angle. It is not uncommon, with current materials, to use forces of up to 1100 pounds to secure such lids in the tooling during the shell forming operation, while lids with essentially vertical connecting portions may be formed using forces of approximately 400–500 pounds. The increased force required during the forming process accelerates wear on tooling, requires increased energy to generate the needed force, and requires increased support during forming to prevent distortion.

Therefore, what is needed is a method for forming can lid shells that enables better control of high strength, thin gauge material while forming can lid shells that decreases material failures, and requires a decreased load on the presses and tooling, thus prolonging the life of the equipment. Additionally, what is needed is apparatus that can achieve the desired method for forming can lid shells.

SUMMARY OF THE INVENTION

To these ends, the present invention contemplates a novel tooling structure and method for making a can lid shell, for use in both single-action and double-action presses. The tooling of this invention comprises upper and lower die sets mounted in a conventional die press. The upper and lower die sets are movable with respect to each other for making the formed can lid shell. The tooling of this invention comprises the addition of a forming ring within the die set. By adding a forming ring inside the die set, the force exerted on the metal during the drawing operation is reduced significantly. Sufficient force only needs to be exerted to prevent wrinkling of the can lid shell material, particularly in the area of the seaming panel, and to withstand panel-forming forces. The invention will be more readily understood from a consideration of the following detailed description of the drawings illustrating the prior art and a preferred embodiment of the invention.

The invention disclosed is a process or apparatus for making a shell for a can lid having a central panel, a countersink, and a seaming panel comprising clamping material in a tool die between a die core ring and a draw pad using a clamping force of less than 1100 pounds, the die core ring having an outer portion against which the material is clamped, a connecting surface profile, and an inner diameter. A portion of the material that will form the central panel is engaged against a die center in the tool die that has an outer diameter that is less than the inner diameter of the die core ring. The die center, and a forming ring between the draw pad and die center are moved in a direction to form both the central panel and the seaming panel. These portions of the shell are formed between the die center, the forming ring and the die core ring, with the forming ring supplying support and applying force to the material between the forming surface of the forming ring and the connecting surface profile of the die core ring.

BRIEF DESCRIPTION OF THE DRAWINGS

The accompanying drawings are incorporated into and form a part of the specification to assist in explaining the present invention. The drawings are intended for illustrative purposes only and are not intended as exact representations of the embodiments of the present invention. The drawings further illustrate preferred examples of how the invention can be made and used and are not to be construed as limiting the invention to only those examples illustrated and described. The various advantages and features of the present invention will be apparent from a consideration of the drawings in which.

DETAILED DESCRIPTION OF THE DRAWINGS

Figure 2:
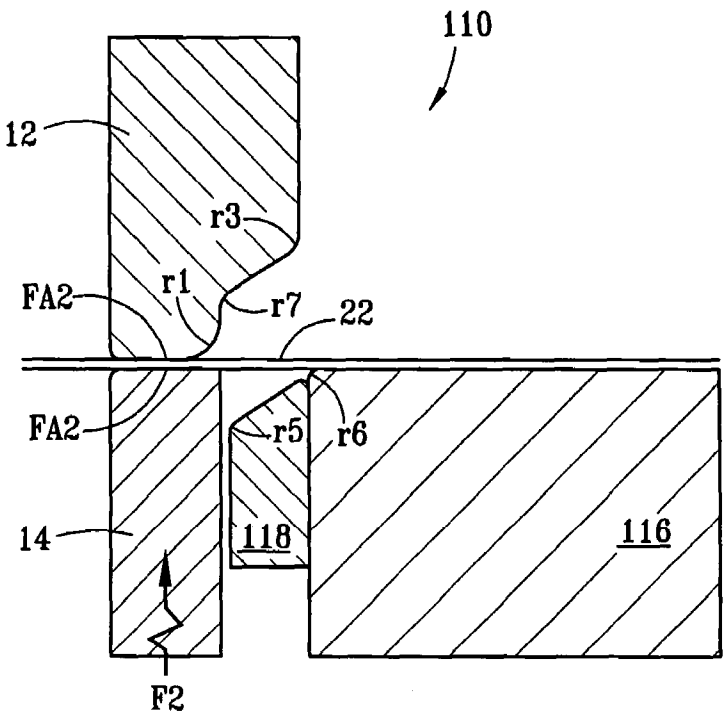
FIG. 2 is a side elevation view in cross-section, of the tooling structure during a lid forming operation, illustrating the position of the various operative components at stage 1 of the lid forming operation.

The present invention is described in the following text by reference to drawings of examples of how the invention can be made and used. The drawings are for illustrative purposes only and are not necessarily exact scale representations of the embodiments of the present invention. In these drawings, the same reference characters are used throughout the views to indicate like or corresponding parts. The embodiments shown and described herein are exemplary. Many details are well known in the art, and as such are neither shown nor described. It is not claimed that all of the details, parts, elements, or steps described and shown were invented herein. Even though numerous characteristics and advantages of the present invention have been described in the drawings and accompanying text, the description is illustrative only, and changes may be made, especially in matters of arrangement, shape and size of the parts, within the principles of the invention to the full extent indicated by the broad general meaning of the terms used in the claims. The words "up," "upward," "down," and "downward" as used in this document, are used in reference to a can lid shell as it would appear when it is in the final position on top of a beverage can.

Figure 1:
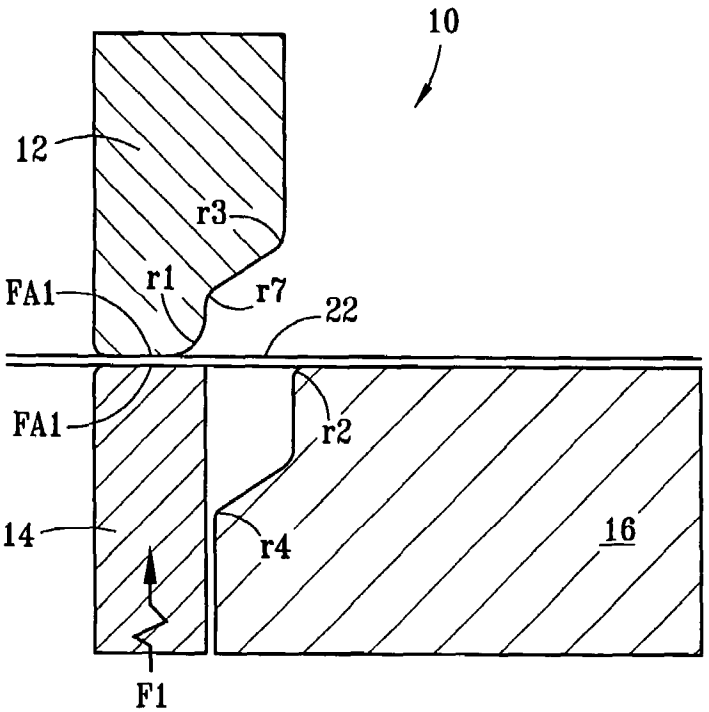
FIG. 1 (PRIOR ART)
FIG. 1 is a side elevation view in cross-section, of the tooling structure of the prior art during a lid forming operation, illustrating the position of the various operative components at stage 1 of the lid forming operation.

FIG. 1 illustrates one embodiment of a known tool die apparatus 10 for making a can lid from metallic material 22. Those skilled in the art will be acquainted with the various methods of forming can lids to provide the general configuration and geometry of the can lid 10 as described herein. The apparatus 10 consists of a die core ring 12, a draw pad 14, and a die center 16. The outer portion of the die core ring 12 that clamps the material 22 against the draw pad 14 has a radius of curvature R1 on the inner curve. Radius R1 is the machining radius typically used to achieve the desired seaming panel radius on the can lid. The material 22 is held between the die core ring 12 and the draw pad 14 by means of force F1, a force of approximately 1000 to 1200 pounds, exerted on the draw pad 14 for lids in which the connecting portion is at an angle, and a force of approximately 400 to 500 pounds exerted on the draw pad 14 for lids in which the connecting portion is approximately vertical. The force F1 is applied to the material 22, holding the material 22 in place between the die core ring 12 and the draw pad 14 at a force area FA1. The inner diameter of the die core ring 12 has a radius of curvature R3 on the outwardly curving portion. Radius R3 is the machining radius typically used to achieve the desired seaming panel radius on the can lid. The die core ring 12 has a radius of curvature R7 on the connecting surface profile portion. Radius R7 is the machining radius typically used to achieve the desired seaming panel radius on the can lid. The die center 16 has a radius of curvature R2 at the edge of the die center 16 that comes in contact with the material 22. Radius R2 is the machining radius typically used to achieve the desired radius for redrawing the lid panel. The die center 16 has a radius of curvature R4 at the edge of the die center 16 that is closest to the draw pad 14. Radius R4 is the obverse of radius R7 on the die core ring 12. Radius R4, in combination with Radius R7, forms the desired seaming panel radius on the can lid.

FIG. 2 illustrates one embodiment of the tool die apparatus 110 of the current invention for making a can lid from metallic material 22. The apparatus 110 of the present invention consists of a die core ring 12, a draw pad 14, a die center 116 and a forming ring 118. The outer portion of the die core ring 12 that clamps the material 22 against the draw pad 14 has a radius of curvature R1 on the inner curve. Radius R1 is the machining radius typically used to achieve the desired seaming panel radius on the can lid. For example, in materials that have a thickness of 0.0088 inches or less, a desired seaming panel radius is typically in the range of 0.055–0.080 inches. The material 22 is held between the die core ring 12 and the draw pad 14 by means of force F2, a force of approximately 200 to 300 pounds, exerted on the draw pad 14. The force F2 is applied to the material 22, holding the material 22 in place between the die core ring 12 and the draw pad 14 at a force area FA2. The inner diameter of the die core ring 12 has a radius of curvature R3 on the outwardly curving portion. Radius R3 is the machining radius typically used to achieve the desired seaming panel radius on the can lid. The connecting surface of the die core ring 12 has a radius of curvature R7 on the inwardly curved portion of the profile. Radius R7 is the machining radius typically used to achieve the desired seaming panel radius on the can lid. The die center 116 has a radius of curvature R6 at the edge of the die center 116 that comes in initial contact with the material 22. Radius R6 is the machining radius typically used to achieve the desired radius to reform the material 22 into the panel wall. The forming ring 118 is located between the draw pad 14 and die center 116. The forming ring 118 provides a support surface for the connecting portion of the seaming panel during the drawing process, reducing the amount of force required, and reducing the probability of wrinkles in the can lid, especially in can lids that have a connecting portion formed at an angle. The forming ring 118 also helps prevent distortion of critical angles and radii formed in the shell drawing process. The forming ring 118 has a radius of curvature R5 at the corner that is closest to the draw pad 14 and material 22. Radius R5 is the obverse of radius R7 on the die core ring 12. Radius R5, in combination with Radius R7, forms the desired seaming panel radius on the can lid. The die center 116 and forming ring 118 move towards the material 22 together to achieve the configuration shown in FIG. 2. The use of a forming ring results in the lid forming process being a draw/redraw process, as opposed to the draw process of the prior art. In one embodiment of the invention, a plurality of upper and lower die sets are installed together in a cooperative matrix or pattern for making a plurality of the formed can lids simultaneously.

Figure 3:
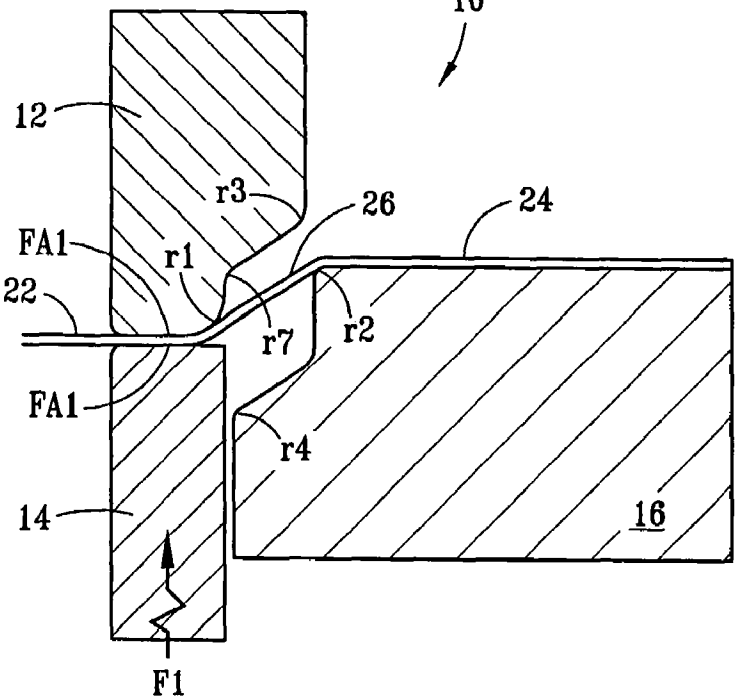
FIG. 3 (PRIOR ART)
FIG. 3 is a side elevation view in cross-section, of the tooling structure of the prior art during a lid forming operation, illustrating the position of the various operative components at stage 2 of the lid forming operation.

FIG. 3 illustrates the second stage of forming a can lid known in the prior art using apparatus 10 for making a can lid from metallic material 22. The material 22 continues to be held between the die core ring 12 and the draw pad 14 by means of force F1 exerted on the draw pad 14. The die center 16 continues to move against the material 22, applying a counter-force which starts the formation of the center panel 24 and the seaming panel 26 of the can lid shell by drawing the material 22 at radius R2 on the die center 16, and at radius R1 on the die core ring 12. As can be seen, no support is provided for the part of the material 22 that will form the connecting portion of the seaming panel 26 at this stage of the process.

Figure 4:
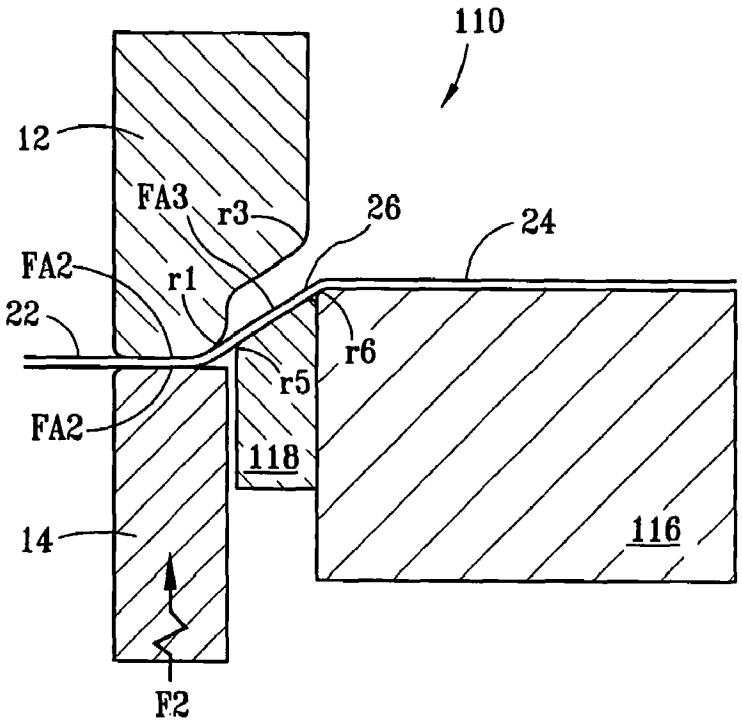
FIG. 4 is a side elevation view in cross-section, of the tooling structure during a lid forming operation, illustrating the position of the various operative components at stage 2 of the lid forming operation.

FIG. 4 illustrates one embodiment of the apparatus 110 of the current invention at the second stage of forming a can lid from metallic material 22. The material 22 continues to be held between the die core ring 12 and the draw pad 14 by means of force F2 exerted on the draw pad 14. The die core ring 116 is exerting a counterforce to the material 22, starting the formation of the center panel 24 by drawing the material 22 at radius R6 on the die center 116. At the point of formation shown in FIG. 4, the forming ring 118 has come in contact with the material 22, and is exerting a counter-force F3, of approximately 200 to 400 pounds at force area FA3, on the material 22, starting the formation of the connecting portion of the seaming panel 26 of the can lid.

Figure 5:
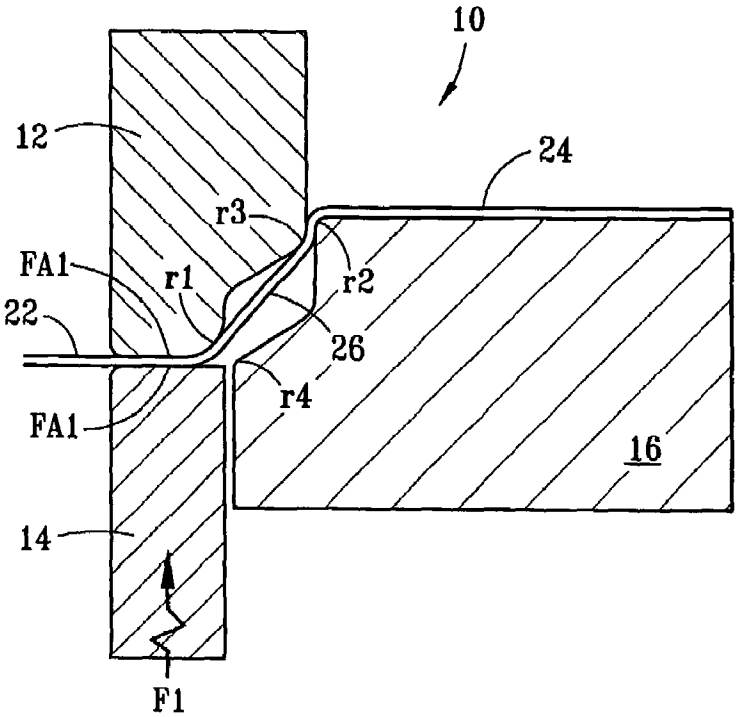
FIG. 5 (PRIOR ART)
FIG. 5 is a side elevation view in cross-section, of the tooling structure of the prior art during a lid forming operation, illustrating the position of the various operative components at stage 3 of the lid forming operation.

FIG. 5 illustrates the third stage of forming a can lid known in the prior art using apparatus 10 for making a can lid from metallic material 22. The material 22 continues to be held between the die core ring 12 and the draw pad 14 by means of force F1 applied to the draw pad 14. At the point of formation shown in FIG. 5, the die center 16 has moved against the material 22, continuing the formation of the center panel 24 and the seaming panel 26 of the can lid shell. One portion of the die center 16 has moved up to and slightly beyond the inner diameter of the die core ring 12, continuing to draw the material 22 at radius R2 on the die center 16, and at radii R1 and R3 on the die core ring 12. As can be seen, no support is provided for the part of the material 22 that will form the connecting portion of the seaming panel 26 at the third stage of the process of forming a lid in the prior art.

Figure 6:
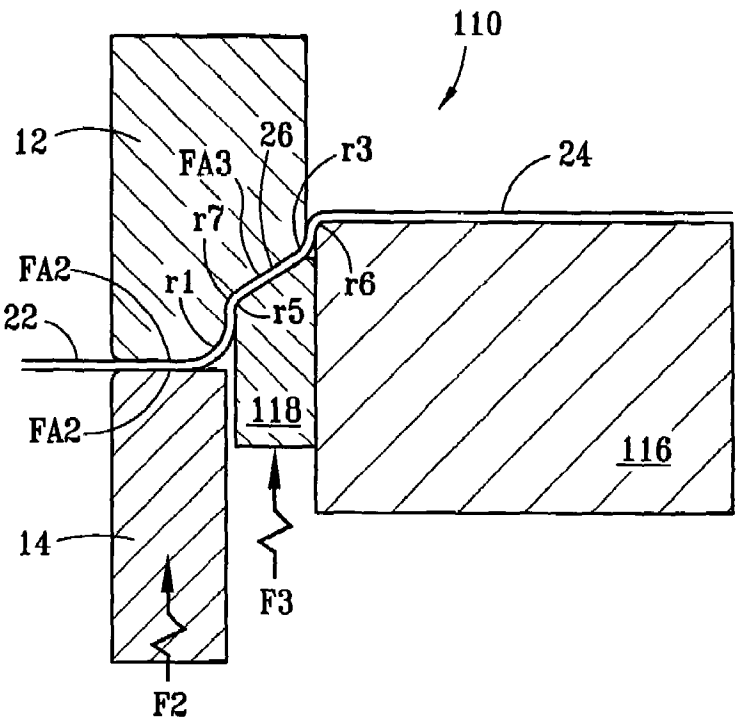
FIG. 6 is a side elevation view in cross-section, of the tooling structure during a lid forming operation, illustrating the position of the various operative components at stage 3 of the lid forming operation.

FIG. 6 illustrates one embodiment of the apparatus 110 of the current invention at the third stage of forming a can lid from metallic material 22. The material 22 continues to be held between the die core ring 12 and the draw pad 14 by means of force F2 exerted on the draw pad 14. At the point of formation shown in FIG. 6, the force F2 is believed to provide only sufficient force to prevent formation of wrinkles in the seaming panel 26. Force F2 is not believed to provide force for the purpose of drawing the material 22 during lid formation. The die center 116 and forming ring 118 have moved against the material 22, for further formation of the center panel 24 and the seaming panel 26 of the can lid shell. The force F3 exerted by forming ring 118 on the material 22, has forced the material 22 against the inner diameter and connecting surface of die core ring 12. The material is drawn at radius R6 on the die center 116, at radius R5 on the forming ring 118, and at radii R1, R3 and R7 on the die core ring 12.

Figure 7:
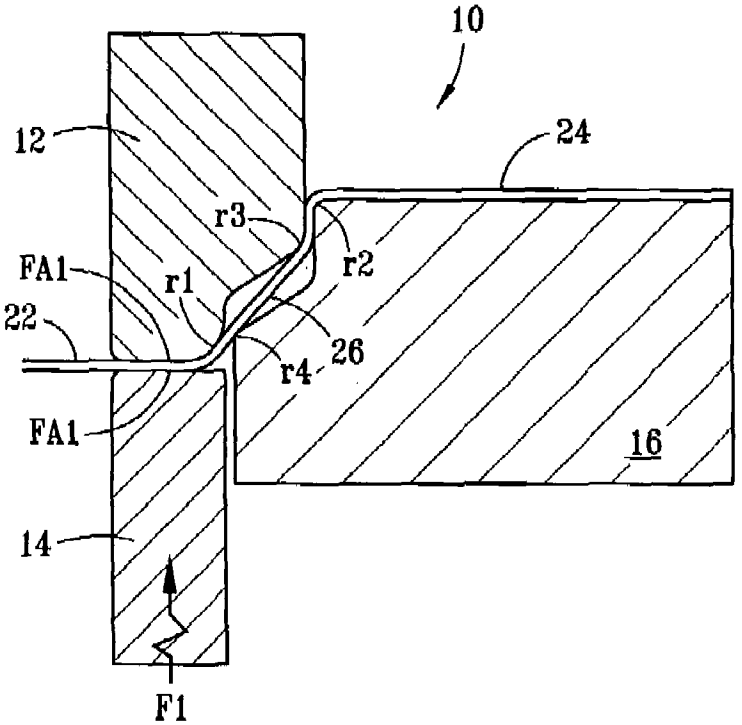
FIG. 7 (PRIOR ART)
FIG. 7 is a side elevation view in cross-section, of the tooling structure of the prior art during a lid forming operation, illustrating the position of the various operative components at stage 4 of the lid forming operation.

FIG. 7 illustrates the fourth stage of forming a can lid known in the prior art using apparatus 10 for making a can lid from metallic material 22. The material 22 continues to be held between the die core ring 12 and the draw pad 14 by means of force F1 exerted on the draw pad 14. At the point of formation shown in FIG. 7, the die center 16 is drawing the material 22, forming the center panel 24 and the seaming panel 26 of the can lid shell. The die center 16 has continued to move further beyond the inner diameter of the die core ring 12, drawing the material 22 at radius R2 on the die center 16, and at radii R1 and R3 on the die core ring 12, and is just starting to contact the material 22 at radius R4 on the die center 16. The primary force for drawing and securing of the material 22 is being proved by means of force F1. At this point in the forming process, the material 22 is subject to tremendous stress and shear, and is prone to buckling or wrinkling, especially in the areas of the material 22 that are not supported.

Figure 8:
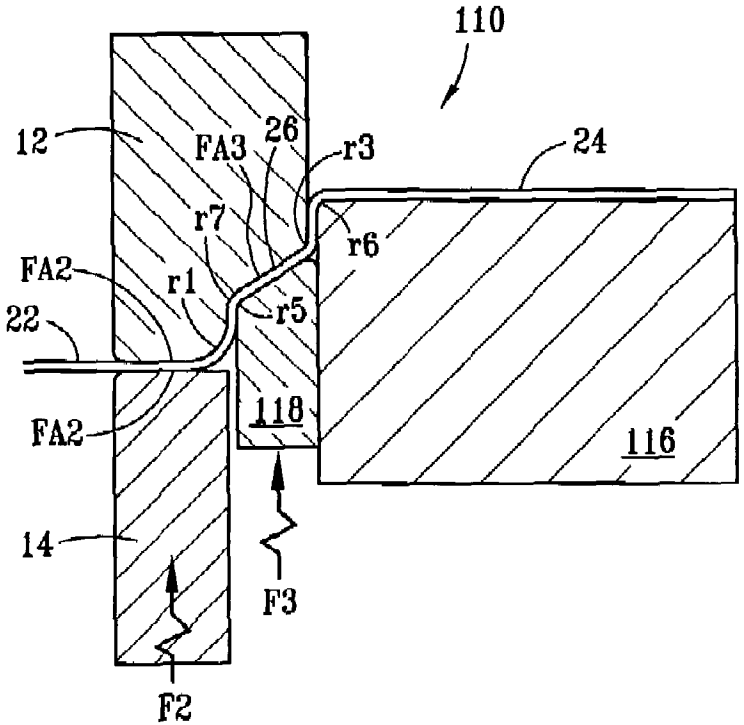
FIG. 8 is a side elevation view in cross-section, of the tooling structure during a lid forming operation, illustrating the position of the various operative components at stage 4 of the lid forming operation.

FIG. 8 illustrates one embodiment of the apparatus 110 of the current invention at the fourth stage of forming a can lid from metallic material 22. The material 22 is held between the die core ring 12 and the draw pad 14 by means of force F2 exerted on the draw pad 14. At the point of formation shown in FIG. 8, the force F2 is believed to be primarily providing force to prevent formation of wrinkles in the seaming panel 26. Force F2 is not believed to be serving the purpose of providing draw force for lid formation. The die center 116 is drawing the material 22, forming of the center panel 24 and the seaming panel 26 of the can lid. The force F3 exerted by forming ring 118 on the material 22 continues to provide the draw pressure for the formation of the center panel 24 and the connecting portion of the seaming panel 26 of the can lid shell. The die center 116 has moved further beyond the inner diameter of the die core ring 12, continuing to draw the material 22 at radius R6 on the die center 116, and at radius R3 on the die core ring 12.

Figure 9:
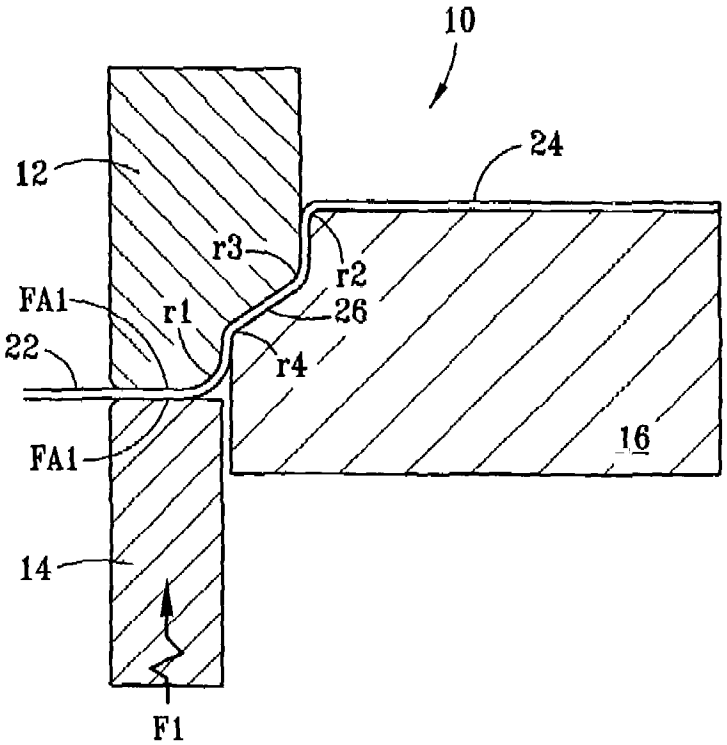
FIG. 9 (PRIOR ART)
FIG. 9 is a side elevation view in cross-section, of the tooling structure of the prior art during a lid forming operation, illustrating the position of the various operative components at stage 5 of the lid forming operation.

FIG. 9 illustrates the fifth stage of forming a can lid known in the prior art using apparatus 10 for making a can lid from metallic material 22. The material 22 is held between the die core ring 12 and the draw pad 14 by means of force F1 exerted on the draw pad 14. At the point of formation shown in FIG. 9, the die center 16 is drawing the material 22, forming the center panel 24 and the seaming panel 26 of the can lid shell. The die center 16 has moved to its furthest point beyond the inner diameter of the die core ring 12, drawing the material 22 at essentially all points between the die center 16 and the die core ring 12. The magnitude of the force for drawing and securing of the material 22 is being provided primarily by means of force F1. At this point in the forming process, the forming of the center panel 24 and the seaming panel 26 are essentially complete.

Figure 10:
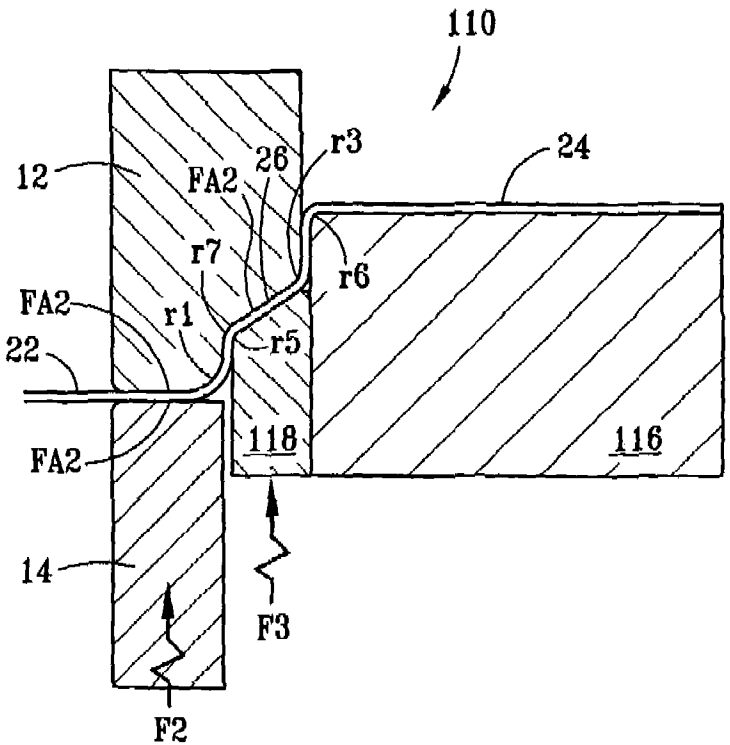
FIG. 10 is a side elevation view in cross-section, of the tooling structure during a lid forming operation, illustrating the position of the various operative components at stage 5 of the lid forming operation.

FIG. 10 illustrates one embodiment of the apparatus 110 of the current invention at the fifth stage of forming a can lid from metallic material 22. The material 22 is held between the die core ring 12 and the draw pad 14 by means of force F2 exerted on the draw pad 14. At the point of formation shown in FIG. 10, the force F2 is believed to be providing force to prevent formation of wrinkles in the seaming panel 26. Force F2 is not believed to be serving the purpose of providing draw force for lid formation. The force F3 exerted by forming ring 118 on the material 22 continues to provide the draw pressure for the formation of the center panel 24 and the connecting portion of the seaming panel 26 of the can lid shell. At the point of formation shown in FIG. 10, the die center 116 has moved to its furthest point beyond the inner diameter of the die core ring 12, essentially completing the formation of the center panel 24 and the seaming panel 26 of the can lid shell.

Figure 11:
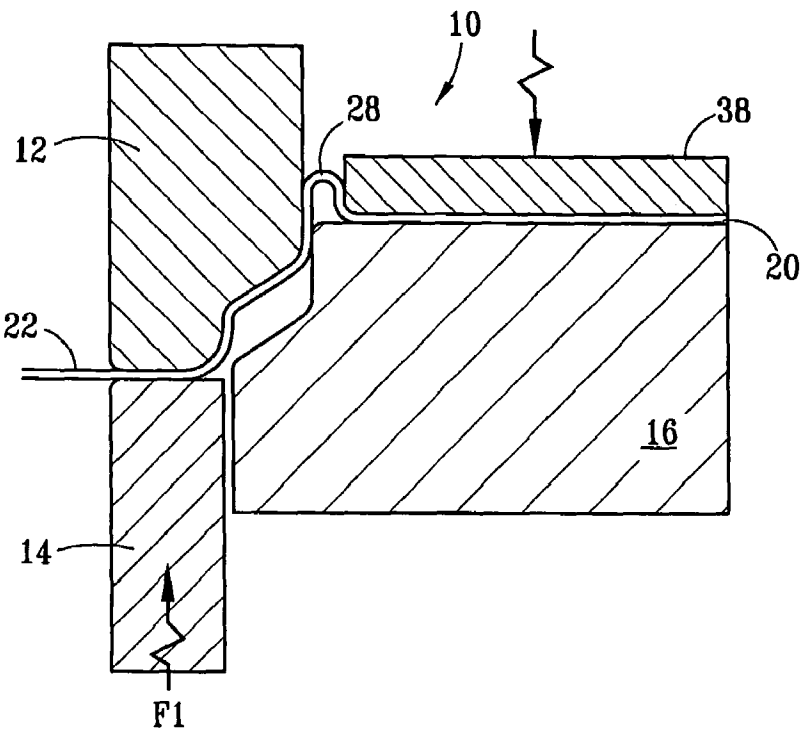
FIG. 11 (PRIOR ART)
FIG. 11 is a side elevation view in cross-section, of the tooling structure of the prior art during a lid forming operation, illustrating the position of the various operative components during the formation of the annular countersink of the lid.

FIG. 11 illustrates the formation of the annular countersink 28 of a can lid known in the prior art using apparatus 10. The material 22 is held between the die core ring 12 and the draw pad 14 primarily by means of force F1 exerted on the draw pad 14. During formation of the annular countersink as shown in FIG. 11, the die center 16 has reversed direction of movement, beginning to move away from the die core ring 12. A panel forming punch 38 moves across the side of the material 22 opposite the die center 16, toward the die core ring 12, pressing the material 22 toward the die core ring 12, forming the annular countersink 28. Although this step in the forming process is described and shown here as occurring after the forming of the can lid shell, in some forming processes, based on the manufacturing equipment used, the formation of the annular countersink occurs at other points in the forming process, although the method is the same as described.

Figure 12:
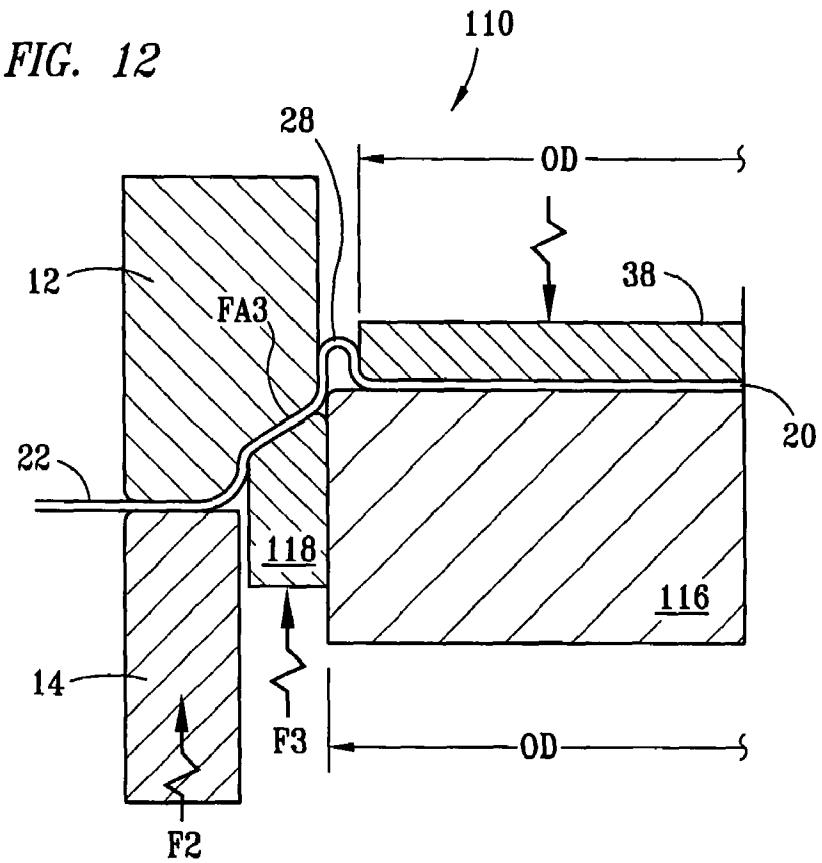
FIG. 12 is a side elevation view in cross-section, of the tooling structure during a lid forming operation, illustrating the position of the various operative components during the formation of the annular countersink of the lid.

FIG. 12 illustrates the formation of the annular countersink 28 of a can lid in one embodiment of the apparatus 110 of the current invention. The material 22 is held between the die core ring 12 and the draw pad 14 primarily by means of force F2 exerted on the draw pad 14, and between the forming ring 118 and the die core ring 12 primarily by means of force F3 exerted on the forming ring 118. Force F3 supports the outer wall of the annular countersink during formation. This substantially prevents the distortion of countersink 28 and also enables the formation of a greater variety of seaming panel wall 26 shapes with a wider variety of radii of curvatures during forming and reforming of the can lid. During formation of the annular countersink 28 as shown in FIG. 12, the die center 116 has reversed direction of movement. A panel forming punch 38, which has an outer diameter D1 that is less than the outer diameter D2 of the die center 116, moves across the side of the material 22 opposite the die center 116, toward the die core ring 12, pressing the material 22 toward the die core ring 12, forming the annular countersink 28. Although this step in the forming process is described and shown here as occurring after the forming of the can lid shell, in some forming processes, based on the manufacturing equipment used, the formation of the annular countersink occurs at other points in the forming process, although the method is similar to the one described here.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present invention have been described in the drawings and accompanying text, the description is illustrative only, and changes may be made in the detail, especially in matters of shape, size, and arrangement of the parts within the principles of the invention to the full extent indicated by the broad meaning of the terms of the attached claims.

The restrictive description and drawings of the specific examples above do not point out what an infringement of this patent would be, but are to provide at least one explanation of how to use and make the invention. The limits of the invention and the bounds of the patent protection are measured by and defined in the following claims.

I claim:

1. A process for making a shell for a can lid, the shell comprising a central panel, a countersink, and a seaming panel comprised of a connecting portion and an outer portion, the process comprising:

holding a material in a tool die between a die core ring and a draw pad by application of a force to the draw pad in the direction of the material just sufficient to hold the material between the die core ring and the draw pad, the die core ring having an outer portion, a connecting surface profile, and an inner diameter;

engaging a portion of the material that will form the central panel against a die center in the tool die, the die center having an outer diameter that is less than the inner diameter of the die core ring;

moving the die center in a direction to form the central panel of the can lid shell by means of application of a counterforce to the die center;

moving a forming ring having a forming surface and being positioned between the draw pad and the die center until the forming surface of the forming ring engages the material that will form the connecting portion of the seaming panel of the can lid shell;

applying a force to the forming ring in the direction of the material to form the connecting portion of the seaming panel of the can lid shell between the connecting surface profile of the die core ring and the forming surface of the forming ring;

continuing to apply a force to the draw pad just sufficient to hold the material in position between the die core ring and the draw pad and prevent the formation of wrinkles in the seaming panel of the can lid shell;

further moving the die center in the direction to form the central panel as the forming ring continues to support and apply force to the material between the forming surface of the forming ring and the connecting surface profile of the die core ring;

reversing the direction of movement of the die center; engaging the central panel of the material with a panel forming punch having an outer diameter less than the outer diameter of the die center; and moving the panel forming punch in a direction toward the material to form the counter sink while the forming ring continues to support and apply force to the material between the forming surface of the forming ring and the connecting surface profile of the die core ring.

2. The process according to claim 1 wherein the forming of the countersink occurs prior to other steps in the process of making the can lid shell.

3. The process according to claim 1 wherein the material for making the can lid shell has an initial thickness of about 0.0088 inches or less.

4. The process according to claim 1 wherein the force applied to the draw pad is less than 900 pounds.

5. The process according to claim 1 wherein the force applied to the draw pad is less than approximately 500 pounds.

6. The process according to claim 1 wherein the force applied to the draw pad is less than approximately 300 pounds.

7. The process according to claim 1 wherein the force applied to the forming ring is less than approximately 400 pounds.

8. An apparatus for making a shell for a can lid comprising:

a die core ring, having an outer portion with a material contacting surface, a connecting surface profile, and an inner diameter;

a draw pad having an outer diameter, an inner diameter, and a material contacting surface;

a first force pack operatively connected to the draw pad for applying a force sufficient to secure the can lid shell between the material contacting surface of the die core ring and the material contacting surface of the draw pad;

a die center having an outer diameter less than the inner diameter of the die core ring;

a forming ring having an inner diameter, an outer diameter and a forming surface;

a second force pack operatively connected to the forming ring;

a panel forming punch having an outer diameter less than the outer diameter of the die center; and a third force pack operatively connected to the panel forming punch.

9. The apparatus according to claim 8 wherein the force provided by the first force pack is less than 1100 pounds.

10. The apparatus according to claim 8 wherein the force provided by the second force pack is less than 1100 pounds.

11. The apparatus according to claim 8 wherein the force provided by the first force pack is less than approximately 900 pounds.

12. The apparatus according to claim 8 wherein the force provided by the first force pack is less than approximately 500 pounds.

13. The apparatus according to claim 8 wherein the force provided by the first force pack is less than approximately 300 pounds.

14. The apparatus according to claim 8 wherein the force provided by the second force pack is less than approximately 400 pounds.

15. The apparatus according to claim 8 wherein the can lid shell made has an initial thickness of about 0.0088 inches or less.

16. A process for making a shell for a can lid, the shell comprising a central panel, a countersink, and a seaming panel comprised of a connecting portion and an outer portion, the process comprising:

holding a material between a die core ring and a draw pad in a tool die by application of a force to the draw pad sufficient to hold the material between the die core ring and the draw pad; forming the central panel of the can lid shell by moving a die center having an outer diameter less than an inner diameter of the die core ring against the held material;

forming the connecting portion of the can lid shell by moving a forming ring against the held material and the held material against the die core ring, the forming ring being positioned between the draw pad and the die center; and forming the countersink by moving the die center away from the held material and moving a panel forming punch against the central panel of the held material on a side of the held material opposite the die center, the panel forming punch having an outer diameter less than the outer diameter of the die center, while maintaining engagement between the forming ring, the held material, and the die core ring.

* * * * *